United States Patent [19]

Shigeo

[11] 4,422,130

[45] Dec. 20, 1983

[54] PORTABLE RECHARGEABLE LIGHTING DEVICE

[75] Inventor: Nomura Shigeo, Sumoto, Japan

[73] Assignee: Sanyo Electric Co., Ltd., Morilguchi, Japan

[21] Appl. No.: 258,544

[22] Filed: Apr. 28, 1981

[30] Foreign Application Priority Data

May 14, 1980 [JP] Japan ..... 55-64249

[51] Int. Cl.[3] ..... F21L 9/00; F21L 7/00; F21L 15/00

[52] U.S. Cl. ..... 362/183

[58] Field of Search ..... 362/183

[56] References Cited

U.S. PATENT DOCUMENTS

| | | | |
|---|---|---|---|
| 3,233,092 | 2/1966 | Umholtz | 362/183 |
| 3,441,730 | 4/1969 | Doring et al. | 362/183 |
| 4,134,635 | 1/1979 | Roche | 362/183 |
| 4,244,011 | 1/1981 | Hammel et al. | 362/183 |

*Primary Examiner*—Irwin Gluck

*Attorney, Agent, or Firm*—Darby & Darby

[57] ABSTRACT

A portable rechargeable lighting device featuring attractive appearance, simple construction and easy operation, in which a handle can protect a charging plug which fixedly protrudes from the body of the device, and disenable the lighting under the charging condition.

14 Claims, 20 Drawing Figures

PORTABLE RECHARGEABLE LIGHTING DEVICE

BACKGROUND OF THE INVENTION

1. Field of the Invention

The present invention relates to a rechargeable type portable lighting device, and more particularly to a portable lighting device of the type, in which a rechargeable battery and other necessary parts are accommodated in the body thereof and in which a charging plug is fixed to protrude from the back or side thereof.

2. Background of the Invention

As the portable rechargeable lighting device of the aforementioned type, there has been disclosed in U.S. Pat. No. 3,233,091 a lighting device which has its charging plug fixedly protruding. The lighting device thus disclosed has defects that the prongs of the protruding charging plug obstruct handling of the device and that the plug may be broken by a foreign substance.

Therefore, there has been proposed in U.S. Pat. No. 3,441,730 a lighting device of the type, in which a charging plug is accommodated in the body thereof, when in the operation other than the charging operation, and can be drawn out by means of an interconnecting wire when in the charging operation. The lighting device thus proposed has defects that the pulling and storage of the wire is troublesome and that it is liable to be troubled due to the disconnection of the wire. There have also been proposed both a lighting device of the type, in which the charging plug is hinged to the body thereof such that it is swung to protrude when in the charging operation, a lighting device of the type, in which the charging plug is detachably attached to the body thereof such that its prongs are made to protrude when only in the charging operation. However, the former has a defect that the construction of the power supply portion including its charging plug becomes complex, whereas the latter has a defect that the charging plug has a fear of being lost.

Moreover, since the charging current to the rechargeable battery to be used in the rechargeable type portable lighting device of one of the aforementioned types is far lower than the discharging current to be supplied from the battery to a bulb or the like, the bulb or the like necessarily has to be extinguished when the charging operation is to be performed. Otherwise, the charging operation cannot be effected. Therefore, there have also conventionally been proposed both a lighting device (as is disclosed in U.S. Pat. No. 3,441,730) of the type, in which the lighting mode of the bulb or the like and the charging mode of the battery are interchanged by means of a manual type switch and a lighting device (as is disclosed in U.S. Pat. No. 3,223,091) of the type, in which the interchange is automatically controlled by means of an electric circuit. However, the former cannot be freed from the operating mistakes of the operator, whereas the latter is accompanied by the complex circuit construction.

SUMMARY OF THE INVENTION

The present invention has been conceived in view of the drawbacks thus far described, and the lighting device of the invention can protect a charging plug and prevent the lighting operation when in the charging operation, with the use of a simple construction.

According to the present invention, there is provided a portable rechargeable lighting device, in which a rechargeable battery and other necessary parts are accommodated in the body thereof and in which a charging plug is disposed to protrude from the back or side thereof, said lighting device being comprised a handle which is hinged to one face of the body thereof such that it is positioned at the protruding face of the charging plug with respect to the body thereof thereby to perform the function of the protecting cover of the charging plug when in the lighting operation thereof and such that it is swung to the other face of the body thereof thereby to allow the charging plug to be connected with or accessed to the ordinary household outlet when in the charging operation.

There is also provided the lighting device as mentioned above which further comprises a switch mechanism which is made operative in response to the motions of the handle so that no electric power is supplied to a built-in bulb when at least in the charging operation even when another possible switch for lighting the bulb is rendered conductive. Further, the lighting device may provide a rotation stopper which is hinged to the handle and positioned swingably in the space surrounded by the handle thereof. The rotation stopper can prevent the handle from swinging relative to the body of the lighting device, when the handle is positioned for the lighting operation at the protruding face of the charging plug, and allows the handle to freely swing, when it is tilted to release the abutment engagement with the aforementioned protruding face, so that the handle can be swung to the aforementioned other position for the charging operation. Preferably, the rotation stopper covers the charging plug under the condition in which the handle is prevented from swinging when in the lighting operation, thereby to perform the function as the plug cover.

DESCRIPTION OF THE PREFERRED EMBODIMENTS

Figure 1:
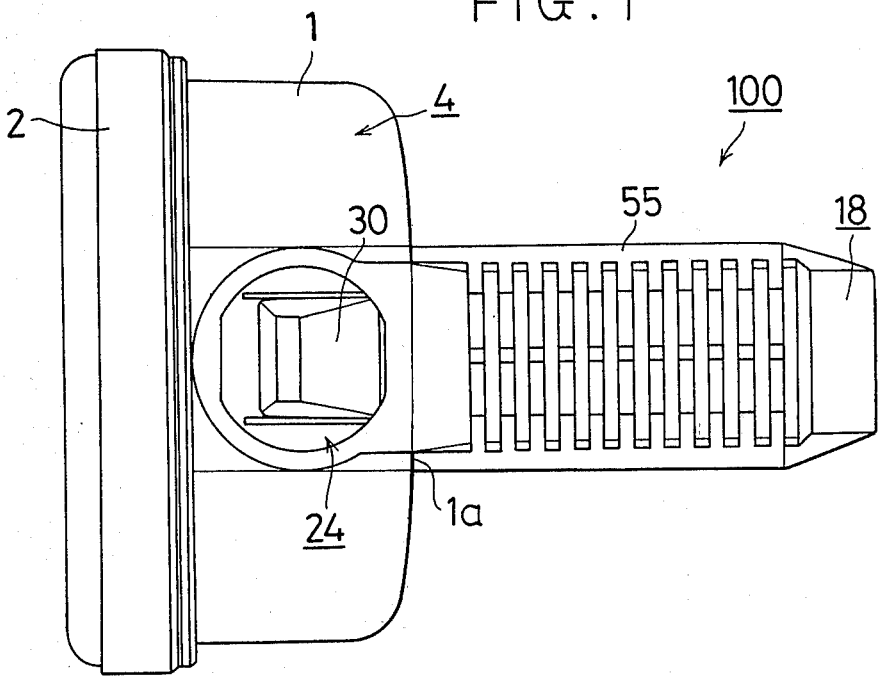
FIG. 1 is a top plan view showing one embodiment of a portable rechargeable lighting device according to the present invention under its lighting condition.
Figure 2:
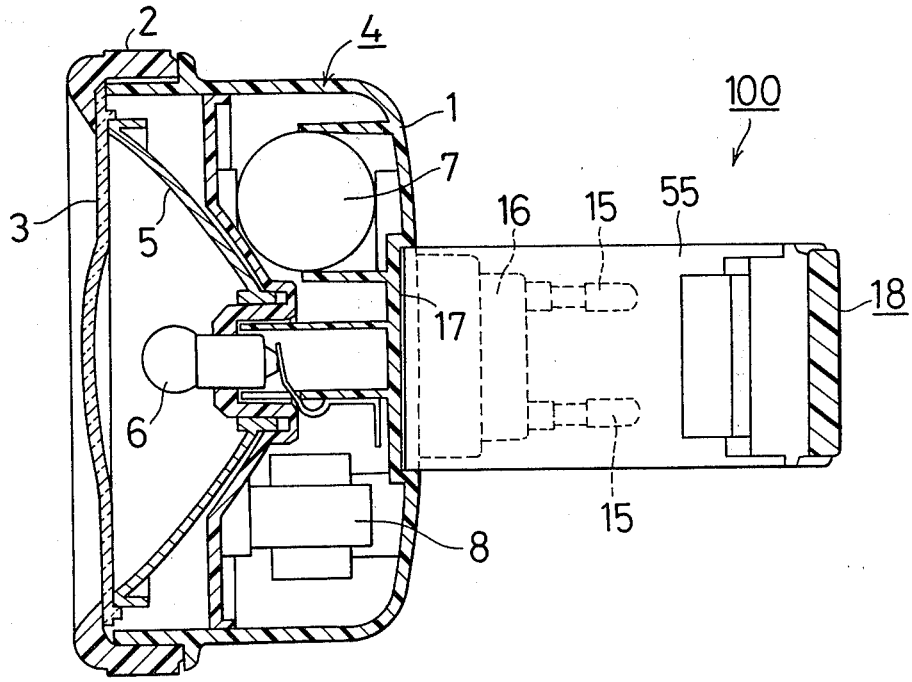
FIG. 2 is a center transverse section showing the portable lighting device of FIG. 1.
Figure 3:
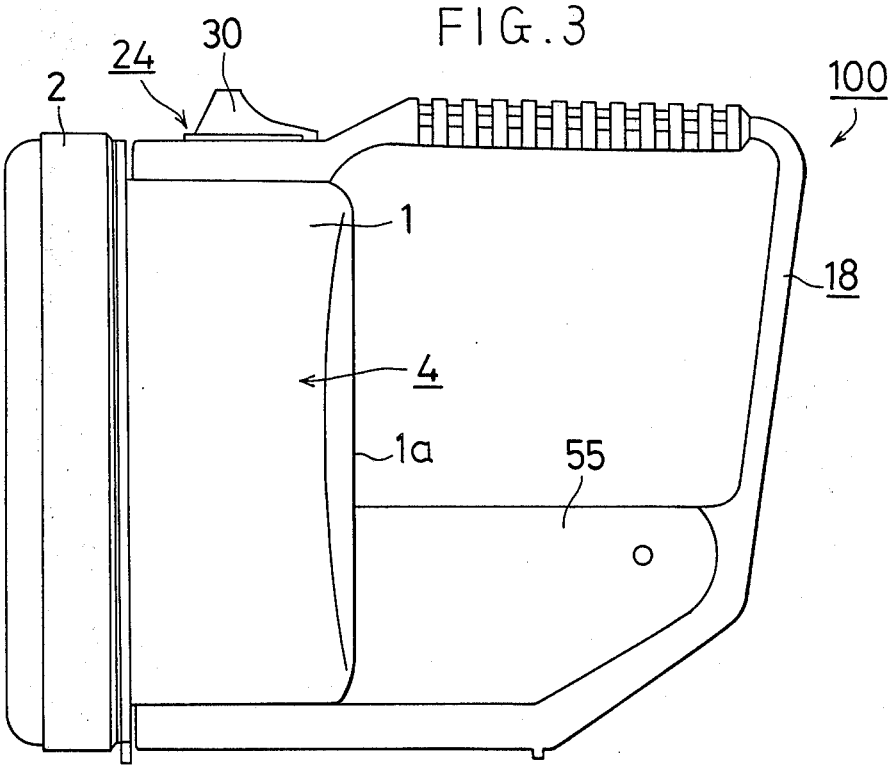
FIG. 3 is a side elevation showing the portable lighting device of FIG. 1.
Figure 4:
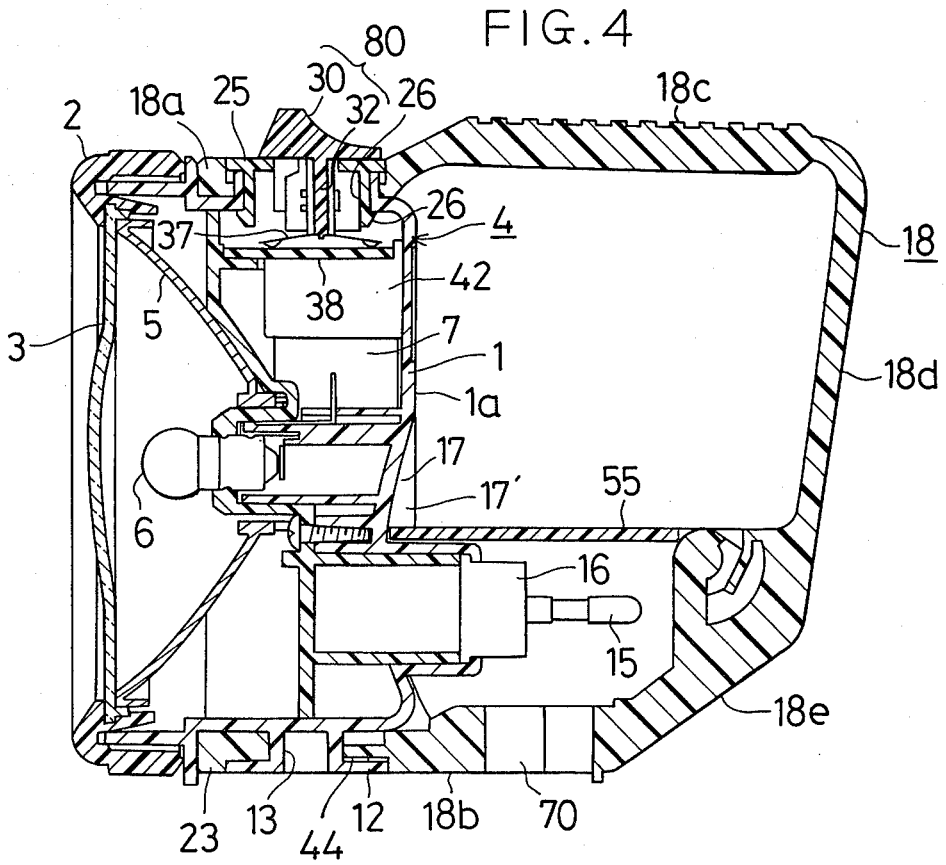
FIG. 4 is a center vertical section showing the portable lighting device of FIG. 1.
Figure 5:
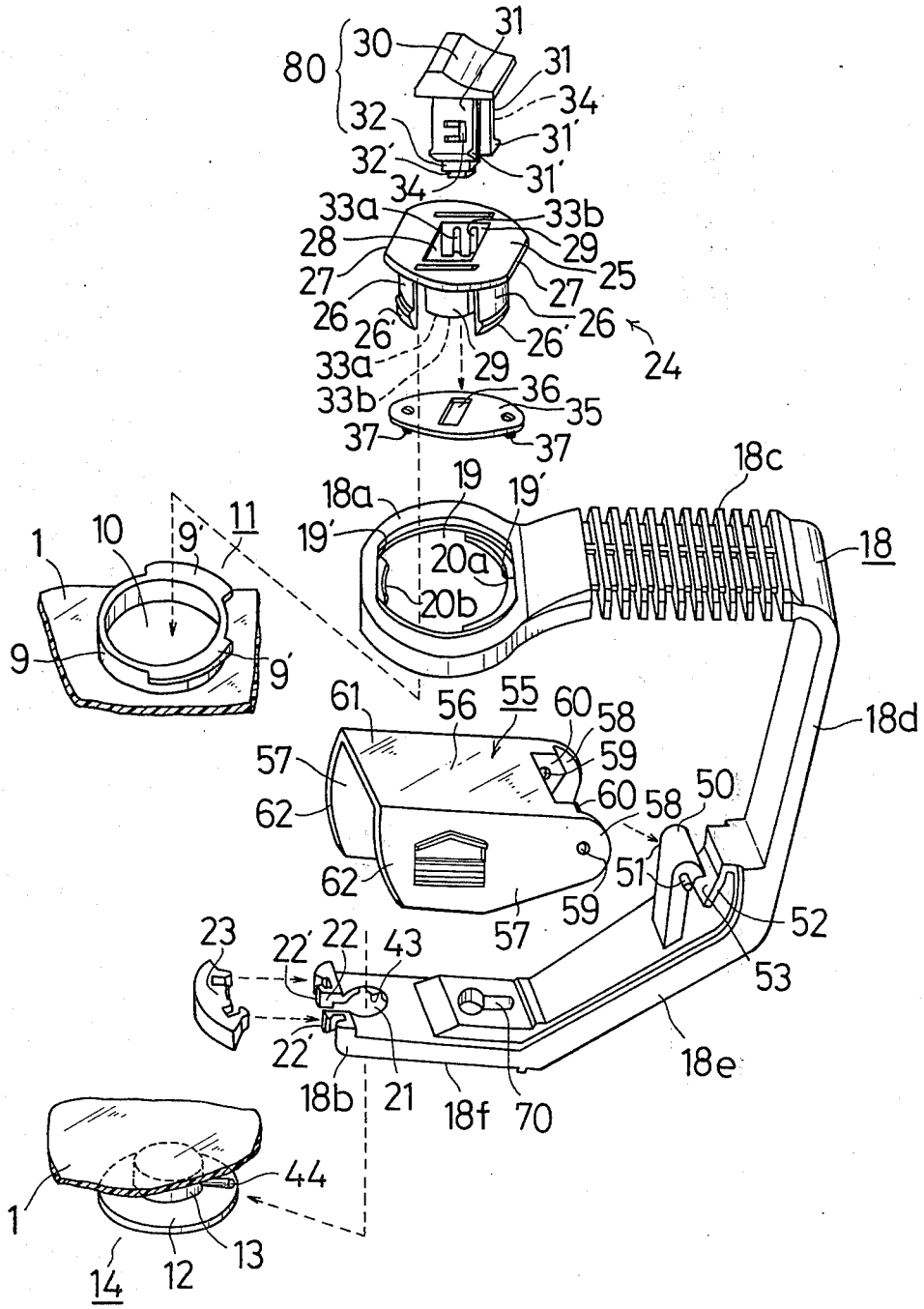
FIG. 5 is an exploded perspective view showing a essential portion of a handle and its surrounding parts of the portable lighting device of FIG. 1.
Figure 6:
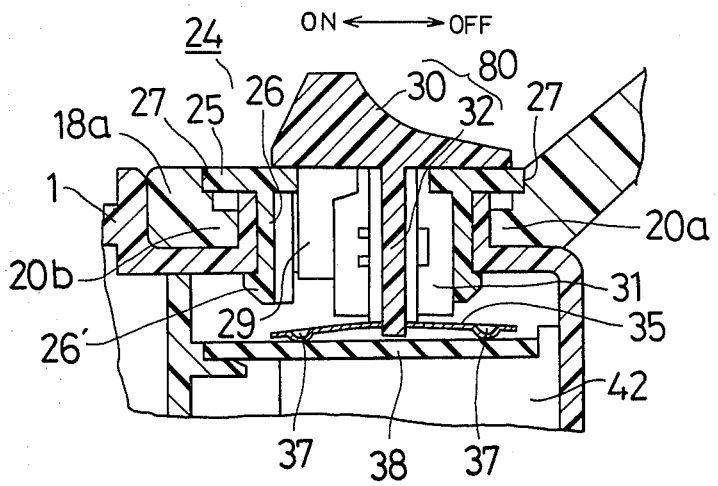
FIGS. 6 and 7 are enlarged vertical sections showing a switch mechanism portion of the portable lighting device of FIG. 1 and showing in parallel and in right angle with the handle, respectively.
Figure 7:
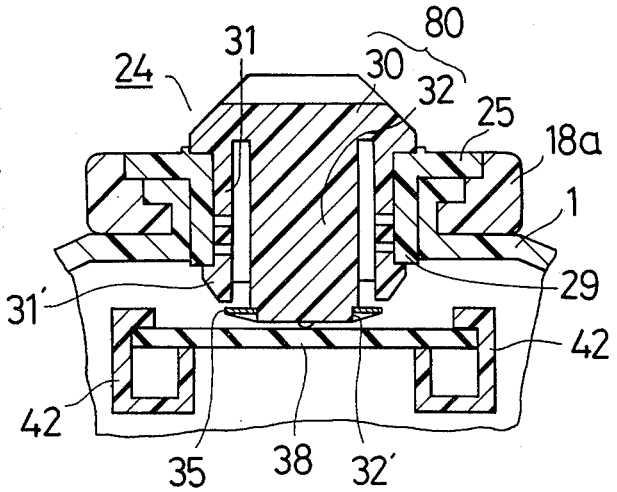

A portable rechargeable lighting device according to the present invention will now be described in conjunction with one embodiment thereof with reference to the accompanying drawings. As shown in FIGS. 1 to 4, the most preferably, in FIG. 2, in the portable lighting device generally indicated at 100, numeral 1 indicates a cylindrical body casing having a front opening, and numeral 2 indicates a lens frame which mounts a lens 3 therein and which covers the aforementioned front opening of the body casing 1. A generally flattened cylindrical body 4 is constructed of the body casing 1 and the lens frame 2. There are accommodated in that body 4 a reflecting mirror 5, a bulb 6, a secondary battery 7 and a charging means such as a transformer 8 and other necessary parts. On the back 1*a* of that body casing 1, moreover, there is mounted a plug-mounting protrusion 16, from which a pair of prongs 15 and 15 for supplying electric power to the aforementioned charging means are made to protrude. As is preferably shown especially in FIG. 4, still moreover, the back 1*a* in the vicinity of the aforementioned protrusion 16 is formed with a recess 17 which is defined by vertical engaging walls 17'. As shown in FIG. 5, still moreover, the upper side of the circumference of the aforementioned body casing 1 is formed with an upper journal 11, from which such a sleeve 9 extends as in formed at its upper end with a pair of fitting flanges 9' and 9' and as is formed with a through hole 10. On the other hand, the lower side of the circumference of the body casing 1 is formed with a lower journal 14, from which such a protruding journal sleeve 13 extends as is formed at its lower end with an externally extending flange 12.

Numeral 18 indicates a generally C-shaped elastic handle which is made of synthetic resin and which has its upper end 18*a* and its lower end 18*b* journally supported on the aforementioned sleeve 9 of the upper journal 11 of the body casing 1 and on the aforementioned protruding journal sleeve 13 of the lower journal 14, respectively, so that it can freely swing from the lefthand side to the righthand side of said body casing 1 through the back 1*a*. The handle 18 is constructed such that it once rises from that upper end 18*a* thereby to form a horizontal grip portion 18*c* and such that it then merges into the lower end 18*b* through a first inclined portion 18*d*, a second inclined portion 18*e* and a lower horizontal portion 18*f*. In the handle 18 thus constructed, numeral 19 indicates an upper circular hole which is formed in the aforementioned upper end 18*a* such that it is fitted on the sleeve 9 of the aforementioned upper journal 11. The upper circular hole 19 has its inner circumference formed with a pair of engaging inner flanges 19' and 19' and its lower end formed at its circumferential edge with fitting larger and smaller edges 20*a* and 20*b* which extends in the inner circumferential direction such that they can be brought into fitting engagement with the sleeve 9 from the circumferential edge portions of the sleeve 9 other than the aforementioned fiting flanges 9' and 9' under the condition in which said handle 18 is positioned in front of the cylindrical body 4. Under the condition in which the handle 18 is swung from the lefthand or righthand side over the back 1*a*, on the contrary, said fitting larger and smaller edges 20*a* and 20*b* are clamped between the upper side surface of the aforementioned body casing 1 around the sleeve 9 and the paired fitting flanges 9' and 9' so that they act to prevent the handle 18 from coming out. Moreover, numeral 21 indicates a lower circular hole which is formed in the lower end 18*b* of the handle 18 thereby to rotatably receive the protruding journal sleeve 13 of the aforementioned lower journal 14. The lower circular hole 21 is formed with a fitting notch 22, which merges thereinto from the end of the aforementioned lower end 18*b*, and is formed at its lower end with a pair of spacer attaching hooks 22' and 22'.

Numeral 23 indicates a spacer which is to be inserted into the aforementioned fitting notch 22 and which is fixedly fitted in the aforementioned spacer attaching hooks 22' and 22'. Thus, the handle 18 is pivotally supported on the lighting device body 4 partly by pivotally fitting the upper end 18*a* of the handle 18 on the upper side of the aforementioned body casing 1 around the sleeve 9, partly by fitting the aforementioned protruding journal sleeve 13 in the lower circumferential hole 21 from the fitting notch 22 of said handle 18, and partly by subsequently fitting said spacer 23.

Incidentally, the lower end 18*b* of the handle 18 around the circumferential edge of the lower circular hole 21 is formed with a plurality of ridges 43, 43 and so on, whereas the side of the flange 12 of the aforementioned protruding journal sleeve 13, which faces said ridges 43, 43 and so on, is formed with a protrusion 44 thereby to provide a nodal motion mechanism which effects nodal rotations of the handle 18 with respect to the lighting device body 4.

On the other hand, that lower holizontal portion 18*f* is formed with a hanging hole 70 which is used when the portable lighting device 100 is retained on a nail driven into a wall.

Numeral 24 indicates a slide switch mechanism which is mounted on the upper journal 11 of the aforementioned body casing 1 thereby to turn on and off the aforementioned bulb 6. In this switch mechanism 24, numeral 25 indicates a disc-chaped switch supporting plate which is mounted in the upper circular hole 19 of the aforementioned handle 18. The switch supporting plate 25 is formed both with a pair of legs 26 and 26, which in turn are formed with such depending snap lands 26' and 26' as are retained in the body casing 1 around the circumferential edge of the aforementioned sleeve 9 through that upper circular hole 19, and with a pair of notched fitting portions 27 and 27 which are fitted in abutment against the aforementioned paired engaging inner flanges 19' and 19' under the condition in which the switch supporting plate 25 is mounted in that upper circular hole 19. The supporting plate 25 thus constructed is swung together with the handle 18. Moreover, said supporting plate 25 is formed with a sliding rectangular hole 28, which extends in parallel with the axial direction of the grip portion 18*c* of the aforementioned handle 18 and which is formed with a pair of supporting members 29 and 29 depending from both the sides thereof.

Next, numeral 30 indicates a switch knob which is mounted on that switch supporting plate 25 such that it is fitted in the sliding rectangular hole 28 of the switch supporting plate 25 in a manner to slide in one direction with respect to said supporting plate 25, i.e., in parallel with the axial direction of the aforementioned grip portion 18*c*. The switch knob 30 is formed with a pair of depending legs 31 and 31, which are positioned to face the aforementioned supporting members 29 and 29 and which are formed with such retaining hooks 31' and 31' as are retained on the lower ends of the aforementioned supporting members 29 and 29 in a manner to slide along the surfaces of said lower ends. Moreover, a sliding plate supporting leg 32 is formed to depend from between the aforementioned paired depending legs 31 and 31 of the switch knob 30. Thus, the switch knob 30 and sliding member supporting leg 32 thus constructed constitute an actuating member 80. Moreover, the aforementioned supporting member 29 is formed with first and second grooves 33*a* and 33*b* for providing a lighting or extinguishing position, and the aforementioned depending leg 31 is formed with a nodal motion protrusion 34 which is to be selectively fitted in those first and second grooves 33*a* and 33*b*.

Next, numeral 35 indicates an oval-shaped switch sliding plate of metal, which belongs to that slide switch mechanism 24 and which acts as a spring. By retaining the stepped leading end portion 32' of the aforementioned sliding plate supporting leg 32 of the aforementioned actuating member 80 in the retaining center hole 36, that switch sliding plate 35 is fixed such that its axial direction is aligned with the sliding direction of the aforementioned switch knob 30, but can slide on a later-described switch base plate 38 while forcing its paired contact portions 37 and 37 into contact with said switch base plate 38.

Figure 8:
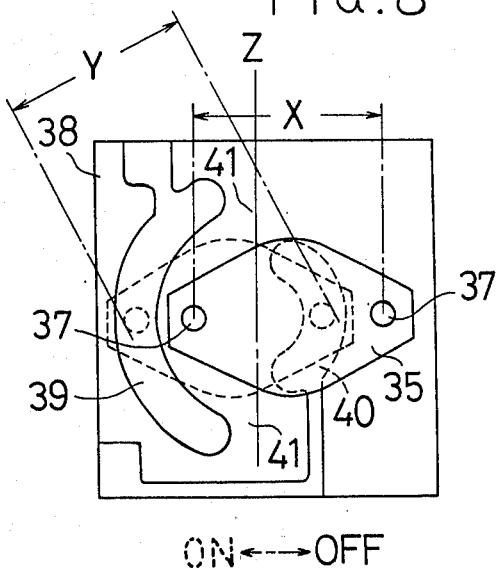
FIGS. 8 and 9 are views showing relationships between a switch base plate and a switch sliding plate of the portable lighting device of FIG. 1 and are top plan views showing the lighting condition and the charging condition, respectively.

As shown in FIGS. 6 to 9, the most preferably, in FIG. 8, the switch base plate 38 has its surface formed with larger and smaller arcuate contact surfaces 39 and 40, which are arranged to face each other such that they are arranged at substantially the same spacing Y as the spacing X between the paired contact portions 37 and 37 of the aforementioned switch sliding plate 35 while holding substantially same spacing even if the switch sliding plate 35 is rotated by the switching motions of the aforementioned handle 18. Between the two ends of the larger arcuate contact surfaces 39 and the two ends of the smaller arcuate contact surfaces 40, moreover, there are formed a pair of gaps 41 and 41 which are freed from contact with the aforementioned contact portions 37 and 37. The switch base plate 38 is fixedly clamped between the attaching ribs 42 of said body casing 1 such that the line Z joining those paired gaps 41 and 41 is directed in parallel with the back 1*a* of the aforementioned body casing 1.

When the portable lighting device thus constructed is used, the aforementioned handle 18 is positioned at the back of the lighting device body 4. If, under this condition, the switch knob 30 is slid into either the lighting position ON or the extinguishing position OFF, the paired contact portions 37 and 37 of said switch sliding plate 35 are brought, as shown in FIG. 8, into and apart from contact with the larger and smaller arcuate contact surfaces 39 and 40 thereby to light or extinguish the aforementioned bulb 6.

Figure 9:
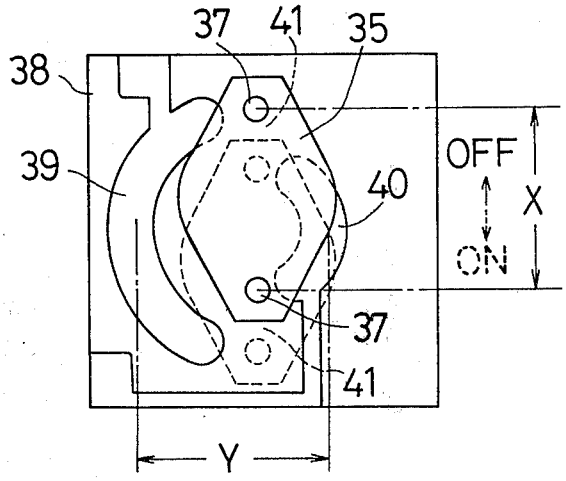
Figure 10:
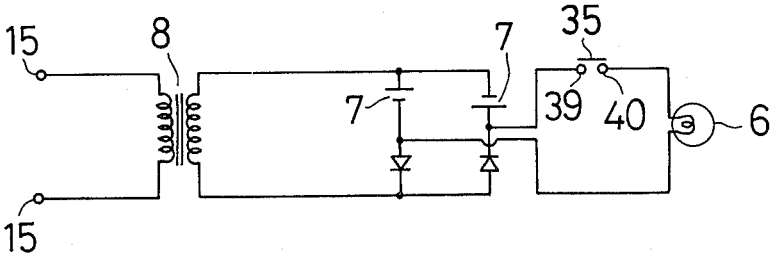
FIG. 10 is an electric circuit diagram.

When said portable lighting device is charged, on the contrary, the aforementioned handle 18 is swung to the right or left of the lighting device body 4 thereby to allow the prongs to be accessed or connected. Under this particular condition, moreover, the switch sliding plate 35 is rotated relative to the switch base plate 38 so that the paired contact portions 37 and 37 of said switch sliding plate 35 come to the aforementioned paired gaps 41 and 41, as shown in FIG. 9. As a result, even if the switch sliding plate 35 is slid to the lighting position ON by manupulating the switch knob 30, said switch sliding plate 35 is slid into contact with neither the larger arcuate contact surface 39 nor the smaller arcuate contact surface 40 thereby hold the aforementioned bulb 6 at its extinguished state. Thus, under this particular condition, the aforementioned prongs 15 and 15 are inserted into the ordinary household outlets (although not shown) thereby to effect the charging operation.

Reverting now to FIG. 5, numeral 50 indicates a plug cover attaching member which is positioned to protrude from the second inclined portion 18*e* of the aforementioned handle 18 at the side of the first inclined portion 18*d* and which has its both right and left ends provided with pins 51 and 51. On the other hand, numeral 52 indicates a knock spring which has its nodal motion surface 53 facing that plug cover attaching member 50.

Numeral 55 indicates a plug cover which is formed into such a generally C-shaped cross-sectional shape as is constructed of a base member 56 and a pair of cover members 57 and 57 depending from both the sides of the base member 56. Those cover members 57 and 57 have their base ends 58 and 58 hinged at their pin holes 59 and 59 to the aforementioned pins 51 and 51 so that the plug cover 55 is swingably positioned in the space which is enclosed by said handle 18. The aforementioned base member 56 has such a length that its free end 61 is fitted in the aforementioned recess 17 when said handle 18 comes to a position in which it is at a right angle with respect to the back 1*a* of the aforementioned body casing 1. On the other hand, those portions of the cover member 57 and 57, which face the aforementioned knock spring 52, are formed with such knock ribs 60 and 60 as are forced into contact with that knock spring 52 thereby to hold the plug cover 55 either under the condition to cover the aforementioned prongs 15 or under the condition to make said prongs 15 exposed. Moreover, the free ends 62 and 62 of those cover members 57 and 57 are formed into such fan-shaped edges as can engage with the aforementioned engaging walls 17' and 17'. The plug cover 55 thus constructed acts as a rotation stopper, as will be described hereinafter.

When the portable lighting device is used, the slide switch knob 30 is actuated under the condition in which the handle 18 is held at a right angle with respect to the lighting device body 4 and in which the free ends 61, 62 and 62 of the plug cover 55 are fitted in the recess 17 of the body casing 1. At this time, said plug cover 55 acts partly to cover the prongs 15 thereby to protect the same and partly to prevent the handle 18 from swinging relative to the lighting device body 4.

Figure 11:
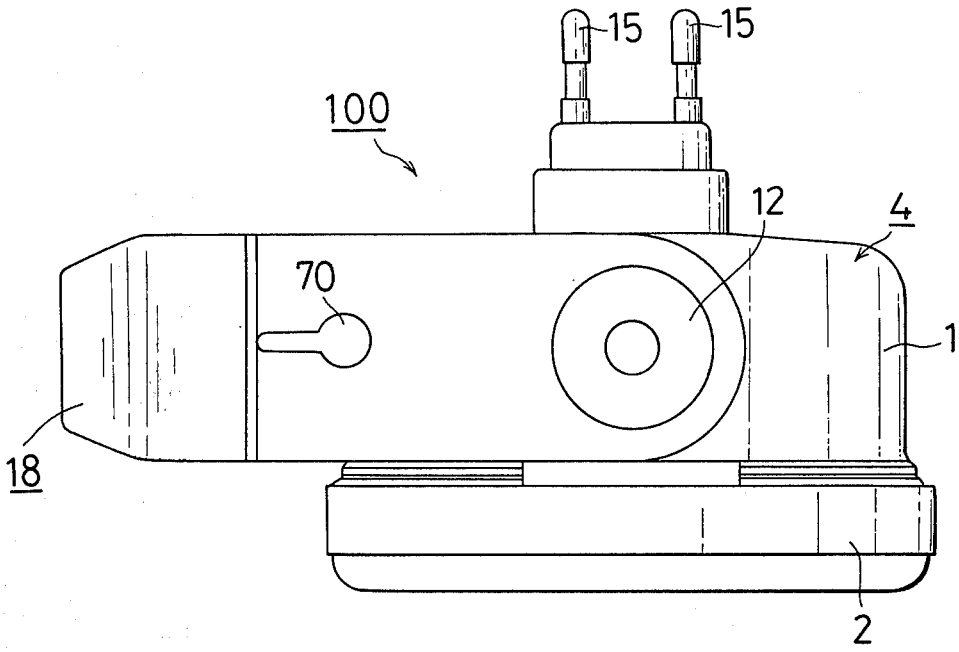
FIG. 11 is a bottom view showing the portable lighting device of FIG. 1 under the charging condition.
Figure 12:
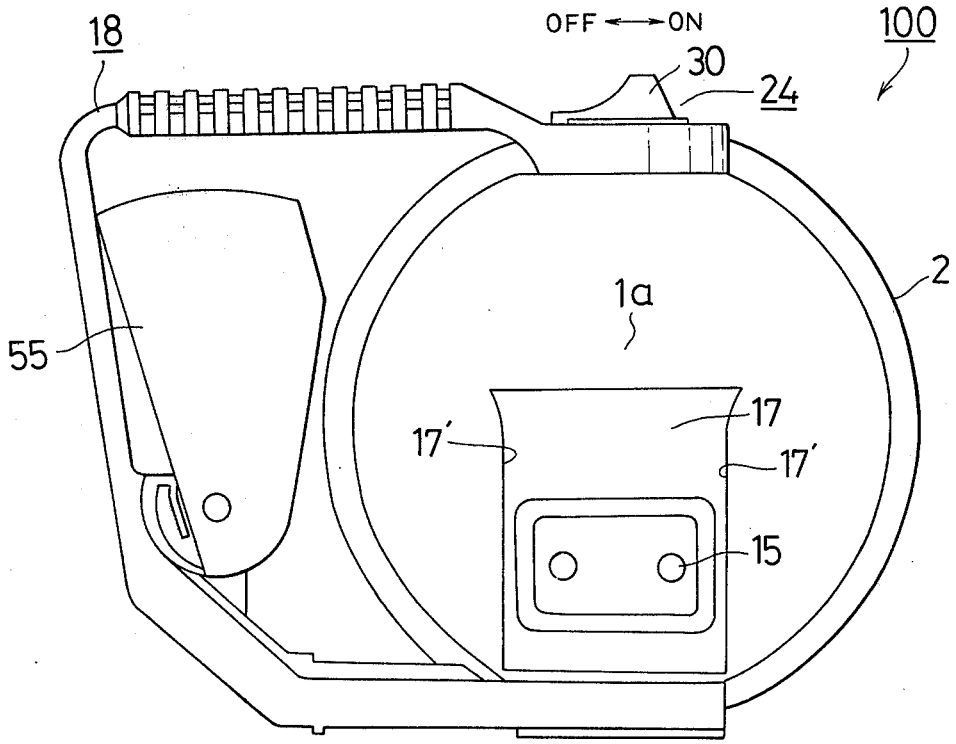
FIG. 12 is a back view showing the portable lighting device of FIG. 11.

When the portable lighting device is charged, on the contrary, as shown in FIGS. 11 and 12, the plug cover 55 is tilted upward thereby to make the prongs 15 accessible, and these prongs 15 are inserted into the ordinary household outlets (although not shown) under the condition in which the handle 18 is swung to the right or left of the lighting device body 4.

Since the prongs are fixed to protrude directly from the back of the lighting device body in accordance with the present invention, the portable lighting device 100 can be simply constructed and excellently assembled.

Moreover, since the portable lighting device of the present invention comprises the handle, which has its both ends hinged to the upper and lower sides of the lighting device body so that it can swing from the right and left sides of said body over the back of said body, and the plug cover which is hinged to said handle so that it can swing within the space enclosed by said handle and so that it covers the aforementioned prongs under the condition having its free ends abutting against the aforementioned back, the prongs are covered, when in the use of the lighting device, with the handle and the plug cover so that the lighting device can be freed from the defects that the prongs obstruct the lighting operation and that the prongs are broken by a foreign substance. Still moreover, the plug cover to cover those prongs has little fear of being lost because it is hinged to the handle and is useful in fixing the handle when in the use of the lighting device.

Still moreover, since the slide switch mechanism for lighting and extinguishing the aforementioned bulb is attached to the hinged portion of that handle and is so constructed that it extinguishes the aforementioned bulb irrespective of the lighting position of the slide switch knob when the aforementioned handle is swung to the other side of the aforementioned lighting device body, the bulb can be completely prevented from being lit, when in the charging operation of the lighting device, merely by swinging the handle from the back of the lighting device body to the side portion of the same body so that the rechargeable battery can be completely charged up irrespective of the sliding position of said slide switch knob.

Still moreover, the lighting device can enjoy another effect that the space for accommodating the handle when the lighting device is laid away is reduced merely by swinging the handle to the side of the light device body.

In the portable lighting device 100, on the other hand, since the bulb can be lit or extinguished by manupulating said slide switch knob when the handle is not positioned at the charging position of the lighting device body, it can be conveniently lit and extinguished under the condition in which the handle is swung to a postiion at 45 degrees with respect to the back of the lighting device body. Moreover, the portable lighting device is convenient because not only the horizontal portion but also the inclined portions of the handle can be stably place upon a floor.

Figure 13:
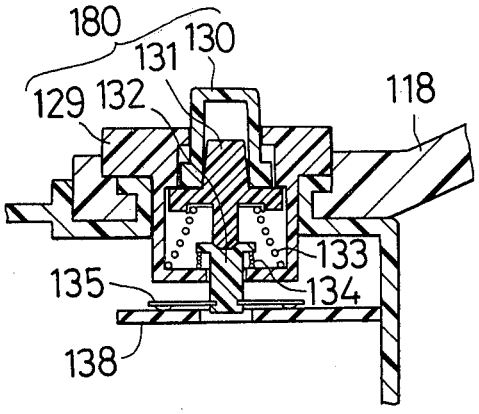
FIGS. 13 and 14 are enlarged vertical sections showing a switch mechanism portion of another embodiment and showing a conditions at the lower and upper positions of a push switch, respectively.
Figure 14:
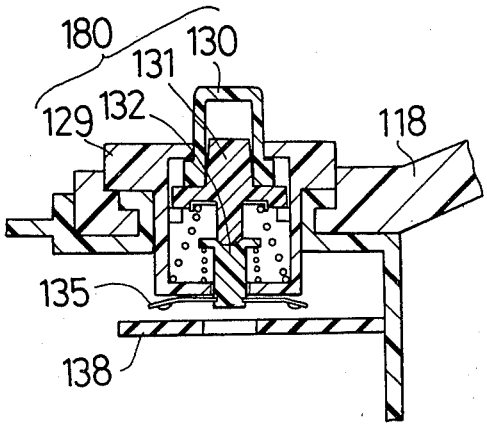
Figure 15:
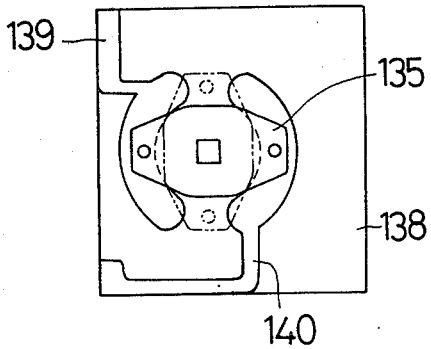
FIG. 15 is a view showing a relationship between a switch base plate and a switch sliding plate of the portable lighting device of the embodiment shown in FIGS. 13 and 14.
Figure 16:
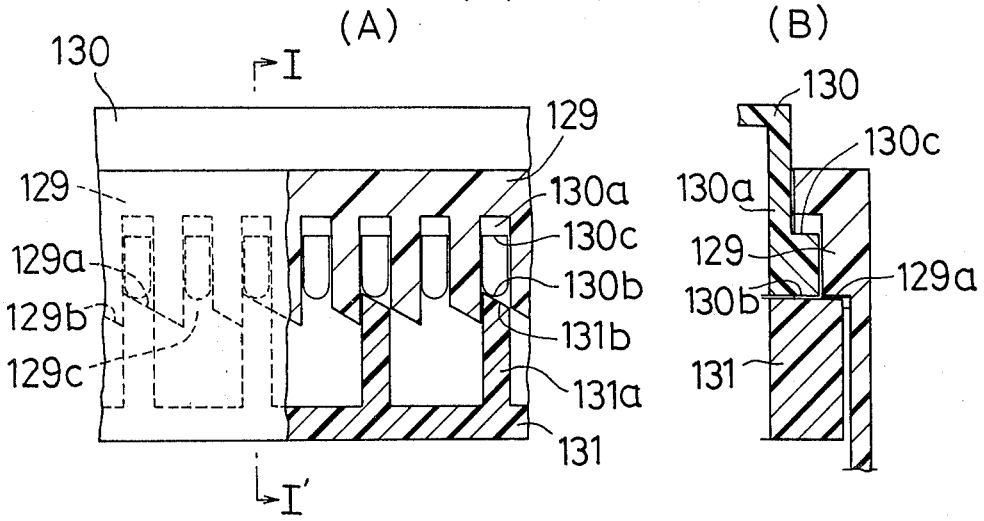
FIGS. 16 and 17 are views explaining the operations of the push switch, of which FIGS. 16(A) and (B) are a side elevation and a section taken along line I—I' under the condition at the lower position of the push switch, respectively, and FIGS. 17(A) and (B) are a side elevation and a section taken along line II—II under the condition at the upper position of the push switch, respectively.
Figure 17:
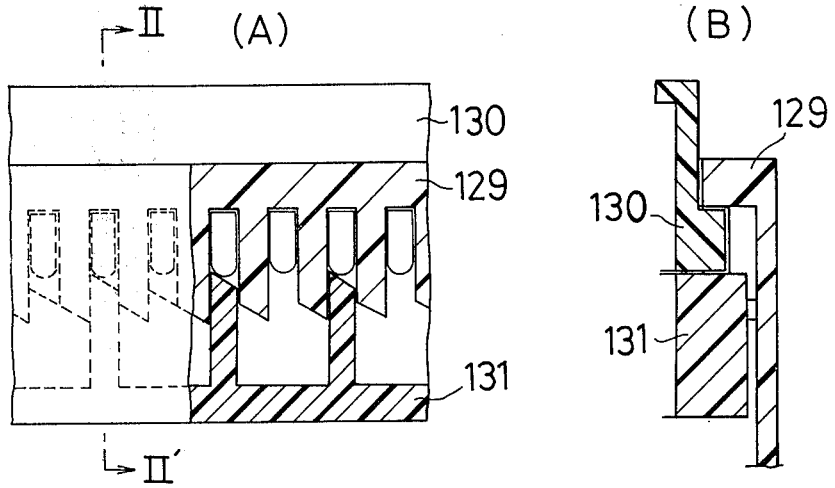

On the other hand, it is possible to modify the lighting device, in which the switch means employs a push switch mechanism. One example of the lighting device of this type is shown in FIGS. 13 to 17. An actuating member 180 shown in FIGS. 13 and 14 is the so-called "push-on-push-off switch", which is moved up and down by pushing a switch button 130 so that it can alternately take the lower position shown in FIG. 13 and the upper position shown in FIG. 14. To the leading end of the sliding plate supporting leg 132 of the actuating member 180, there is attached a switch sliding plate 135, which contacts with a switch base plate 138 at the lower position of the actuating member 180 and leaves the switch base plate 138 at the upper position of the actuating member 180. In FIG. 15 showing the positional relationship between the switch sliding plate 135 and the contact surfaces 139 and 140 of the switch base plate 138, solid lines show the condition under which the handle is at its lighting position, whereas broken lines show the condition under which the handle is at its charging position. As is apparent from FIG. 15, when the handle is under its lighting condition, the bulb can be turned on and off in response to the fact that the switch sliding plate 135 is brought into and out of contact with the switch base plate 138. When the handle is swung a right angle to its charging position, however, the bulb is disenabled to be lit. The structure, in which the actuating member 180 alternately takes the lower and upper positions, is such a well-known one as is shown in FIGS. 16 and 17. Specifically, a rotary member 131, which is always subjected to the upward pushing force by the actions of springs 133 and 134, as shown in FIG. 13, is stopped by the stop flange **129*a* of a fixing member 129 so that it is held at the lower position. If the push button 130 is depressed against the aforementioned upward pushing force, the rotary member 131 receives the component of force in the leftward direction, as viewed from the drawings, partly because its upward leg 131*a* is inclined at the upper end 131*b* thereof and partly because the push button 130 has its downward leg 130*a* protruding into a rounded lower end 130*b*. As a result, the rotary member 131 leftwardly rotates at a position below the slide flange 129*b* of the fixing member 129. If the push button 130 is released, the rotary member 131 is raised by the aforementioned upward pushing force, whereupon the inclined surface of the upper end of the upward leg thereof slides on the inclined surface of the lower end of the slide flange 129*b* so that the rotary member 131 further rotates in the leftward direction. Then, the upward leg 131*a* is fitted in the groove 129*c* of the fixing member 129 thereby to raise the push button 130 so that the stop flange 130*c* of the downward leg 130*a* of the push button 130 is brought into abutment engagement with the fixing member 129 until it is stopped. This is the upper position. If the push button 130 is then depressed, the push button 130** is likewise moved again to the lower position, as will be easily understood.

In case the push switch mechanism is employed as the switch means, it becomes more difficult to discriminate whether the switch is under its "ON" or "OFF" condition than the case of the slide switch mechanism. Therefore, the charging operation is liable to take place while having the switch conductive. However, this can be obviated in the portable rechargeable lighting device according to the present invention.

Figure 18:
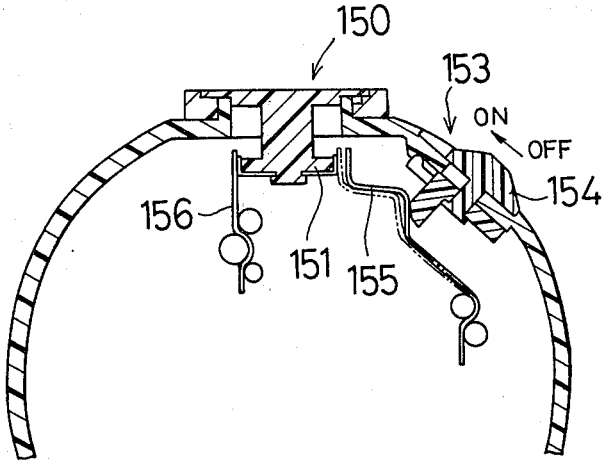
FIG. 18 is a vertical section showing an essential portions of a switch mechanism portion according to a further embodiment.
Figure 19:
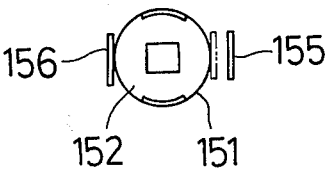
FIGS. 19 and 20 are views showing a switch base plate portion of the embodiment of FIG. 18, as viewed from downside and show the condition, in which a handle is at its lighting position, and a condition in which the handle is at its charging position, respectively.
Figure 20:
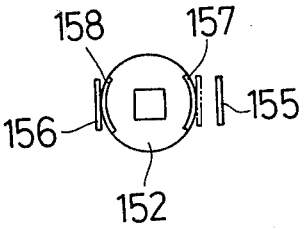

As another embodiment, it is possible to modify the lighting device of the type, in which the actuating member is disposed at a position being different from the position of the switch mechanism. One example thereof is shown in FIGS. 18 to 20. A switch mechanism 150 is attached to the hinged portion of the handle, but a actuating member 153 is disposed at the side portion of the body. The switch mechanism 150, which is made rotatable with the handle, has its switch base plate 151 formed with a contact surface 152 in such a pattern as is shown in FIGS. 19 and 20. Consequently, when under the condition of FIG. 19, in which the handle is at its lighting position, a contact member 155 is brought into and out of contact with the contact surface 152 by manupulating the slide switch knob 154 of an actuating member 153 so that the bulb can be turned on and off. However, when under the condition of FIG. 20, in which the handle is at its charging position, the contact members 155 and 156 cannot contact with the portions 157 and 158 of the switch base plate 151 other than the contact surface 152 so that the bulb never fails to be disenabled to be lit.

As another alternative embodiment, it is possible to modify the lighting device, in which the charging plug is disposed to protrude from the upper side of the body, and wherein the generally C-shaped handle is hinged to the right and left sides of said body with its both end portions. In the time to use, the handle is turned upwardly, the lighting device is hung as a lantern.

Since the above as well as other modifications and changes are intended to be within the scope of the present invention, the foregoing description should be construed as illustrative and not in the limiting sense, the scope of the invention being defined by the appended claims.

What is claimed is:

1. A portable rechargeable lighting device comprising:

a body including a light bulb and a rechargeable battery;

switch means for switchably coupling said light bulb to said battery;

charging plug for receiving electric current for charging said battery; and a handle swingably coupled to said body positionable in a lighting position and a charging position, said handle covering said charging plug when in said lighting position.

2. The portable rechargeable lighting device according to claim 1 wherein said switch means includes means for preventing energization of said light bulb when said handle is in said charging position.

3. A portable rechargeable lighting device according to claim 2, wherein said switch mechanism is mounted on the hinged portion of said handle to said lighting device body.

4. A portable rechargeable lighting device according to claim 2 or 3, wherein said switch mechanism includes a switch base plate fixed to said lighting device body, and a switch sliding plate made slidable on said switch base plate, said switch base plate having such a contact surface as can be slid into contact with said switch sliding plate, when said handle is at its lighting position, but cannot be slid into contact with said switch sliding plate when said handle is at its charging position.

5. A portable rechargeable lighting device according to claim 1, wherein said switch means includes an actuating member for lighting and extinguishing said bulb from the outside.

6. A portable rechargeable lighting device according to any of the claims 2, wherein said switch means includes an actuating member for lighting and extinguishing said bulb from the outside when said handle is at its lighting position.

7. A portable rechargeable lighting device according to claim 6, wherein said actuating member is disposed above said switch mechanism.

8. A portable rechargeable lighting device according to claim 7, wherein said actuating member is attached to said handle in a manner to rotate together with said handle and to slide only in one direction relative to said handle and is made to support said switch sliding plate in a manner to slide relative to said switch base plate.

9. A portable rechargeable lighting device according to claim 7, wherein said actuating member is attached to said handle in a manner to rotate together with said handle and to move up and down relative to said handle and is made to support said switch sliding plate in a manner to move into and out of contact with said switch base plate.

10. A portable rechargeable lighting device according to claim 6, wherein said actuating member is disposed at an arbitrary position of said body or handle other than at the position above said switch mechanism.

11. A portable rechargeable lighting device according to any of the preceding claims 1, wherein said charging plug is disposed to protrude from the back of said lighting device body, and wherein said handle is formed into such a general shape of letter "C" as has its both end portions hinged to the upper and lower sides of said lighting device body thereby to provide said charging position when said handle is swung to the right or left.

12. A portable rechargeable lighting device according to any of the preceding claim 11, further comprising a rotation stopper hinged to said handle such that it can swing in the space which is surrounded by said handle and said lighting device body and such that it can have its free ends abutting against the face where the charging plug is disposed therby to stop the rotations of said handle.

13. A portable rechargeable lighting device according to claim 12, wherein said rotation stopper is a plug cover which is made operative to cover said charging plug under the condition in which said handle is prevented from rotating.

14. A portable rechargeable lighting device according to any of the preceding claim 1, wherein said handle is formed at its arbitrary position with a hole for hanging.

* * * * *